US005435278A

United States Patent [19]

Van Reatherford

[11] Patent Number: 5,435,278

[45] Date of Patent: Jul. 25, 1995

[54] CYLINDER HEAD AND SPARK PLUG ASSEMBLY AND METHOD OF USING THE SAME

[75] Inventor: Larry Van Reatherford, Warren, Mich.

[73] Assignee: Ford Motor Company, Dearborn, Mich.

[21] Appl. No.: 270,277

[22] Filed: Jul. 5, 1994

[51] Int. Cl.[6] ..... F02B 75/08

[52] U.S. Cl. ..... 123/169 EL; 123/169 E; 123/193.3

[58] Field of Search ..... 123/193.3, 193.5, 169 R, 123/169 EL, 169 E, 169 CB; 313/130, 143

[56] References Cited

U.S. PATENT DOCUMENTS

| | | | |
|---|---|---|---|
| 2,003,453 | 6/1935 | McDougal | 123/169 |
| 2,427,291 | 9/1947 | Marette et al. | 201/76 |
| 2,927,144 | 4/1956 | Bychinsky | 123/169 |
| 3,451,110 | 6/1969 | Bray | 29/25.12 |
| 3,594,883 | 7/1971 | Bray | 29/25.12 |
| 3,783,331 | 1/1974 | Darnall | 315/18 |
| 3,967,230 | 6/1976 | Kamigaito et al. | 123/169 R |
| 4,007,714 | 2/1977 | Jones | 123/169 R |
| 4,532,896 | 8/1985 | Nakahara et al. | 123/193.5 |
| 4,549,508 | 10/1985 | Fujimoto | 123/193.5 |
| 4,924,829 | 5/1990 | Cheng et al. | 123/259 |
| 4,989,557 | 2/1991 | Penney | 123/169 EL |
| 5,133,328 | 7/1992 | Sato et al. | 123/169 EL |
| 5,301,641 | 4/1994 | Kasai et al. | 123/193.5 |

*Primary Examiner*—Marguerite Macy

*Attorney, Agent, or Firm*—Roger L. May; Gregory P. Brown

[57] ABSTRACT

A cylinder head and spark plug assembly for mounting on an engine block to create a combustion chamber for burning fuel and method for assembling the same are disclosed. A cylinder head has an end wall with an exterior surface and an interior surface and a spark plug bore extending downstream from the exterior surface to the interior surface. The spark plug bore has a seal surface adjacent the interior surface and external threads disposed upstream from the seal surface. A spark plug includes a body terminating in an end portion having a seal surface thereon, a nut and external threads disposed between the nut and the seal surface. The external threads of the spark plug are threadedly retained within the internal threads of the spark plug bore with the spark plug seal surface cooperating with the cylinder head seal surface in an interference fit eliminating any crevice between the end portion of the body and the spark plug bore downstream of the interference fit. Therefore, combustible fuels cannot reside in crevices between the body and the bore and escape being ignited during fuel burning in the combustion chamber.

11 Claims, 2 Drawing Sheets

CYLINDER HEAD AND SPARK PLUG ASSEMBLY AND METHOD OF USING THE SAME

TECHNICAL FIELD

The present invention relates to spark plugs and cylinder heads and the installation of spark plugs within cylinder heads.

BACKGROUND ART

An important consideration in designing internal combustion engines is minimizing emissions of hydrocarbons expelled from the engines. Even small advances in decreasing the amount of hydrocarbon emissions per vehicle is significant when multiplied by thousands or millions of vehicles.

One source of hydrocarbon emissions is unburned fuel which is exhausted from combustion chambers. A small portion of the fuel located in a combustion chamber may be disposed in crevices in fluid communication with the combustion chamber. These crevices are formed between components defining the combustion chamber such as engine blocks, pistons, seals, cylinder heads and spark plugs. The hard-to-reach fuel located in these crevices may escape a flame front created by introducing a spark into a fuel filled combustion chamber. The unburned fuel may then escape into the atmosphere from the combustion chamber during an exhaust stroke of the engine.

As an example, a spiral-shaped crevice is formed in the gap between the external threads of a spark plug and the receiving internal threads cut into a cylinder head. The present invention is intended to eliminate this crevice.

SUMMARY OF THE INVENTION

An object of the present invention is to reduce the amount of crevice volume found in fluid communication with a combustion chamber of an internal combustion engine.

Another object is to provide a spark plug having a tapered annular seal surface which mates in an interference fit condition with an opposing tapered annular seal surface on a spark plug bore of a cylinder head to eliminate any crevice formed between the seal surfaces which are in fluid communication with an associated combustion chamber.

Yet another object is to provide a spark plug having a filler element between an insulator and an outer body adjacent a spark plug gap to reduce crevices in the spark plug.

In carrying out the above objects and other objects of the invention, a cylinder head and spark plug assembly is provided for mating with an engine block having a cylinder bore therein to create a combustion chamber for burning combustible gases. The assembly comprises a cylinder head and a spark plug.

The cylinder head has an end wall with an exterior surface and an interior surface and a spark plug bore extending downstream from the exterior surface to the interior surface. The interior surface cooperates with a cylinder bore of an engine block to create a combustion chamber for burning combustible gases. The spark plug bore has a seal surface adjacent the interior surface and external threads disposed upstream from the seal surface.

The spark plug includes a body terminating in an end portion having a seal surface thereon, a nut and external threads disposed between the nut and the seal surface. The external threads of the spark plug are threadedly retained within the internal threads of the spark plug bore defining a thread gap therebetween. The spark plug seal surface cooperates with the cylinder head seal surface in an interference fit eliminating any crevice between the end portion of the body and the spark plug bore downstream of the interference fit. Ideally, at least one of the seal surfaces is tapered, and preferably both.

The spark plug has a central insulator disposed within the body with a central electrode extending through the insulator. A ground electrode extends from the terminal end portion forming a spark gap between the electrodes. An annular chamber may be formed between the end portion of the body and the insulator with a filler element disposed in the annular chamber eliminating crevices between the end portion and the insulator.

BRIEF DESCRIPTION OF THE DRAWINGS

These and other features, objects, and advantages of the present invention will become readily apparent from the following description, pending claims, and accompanying sheets of drawings where:

BEST MODES FOR CARRYING OUT THE INVENTION

Figure 1:
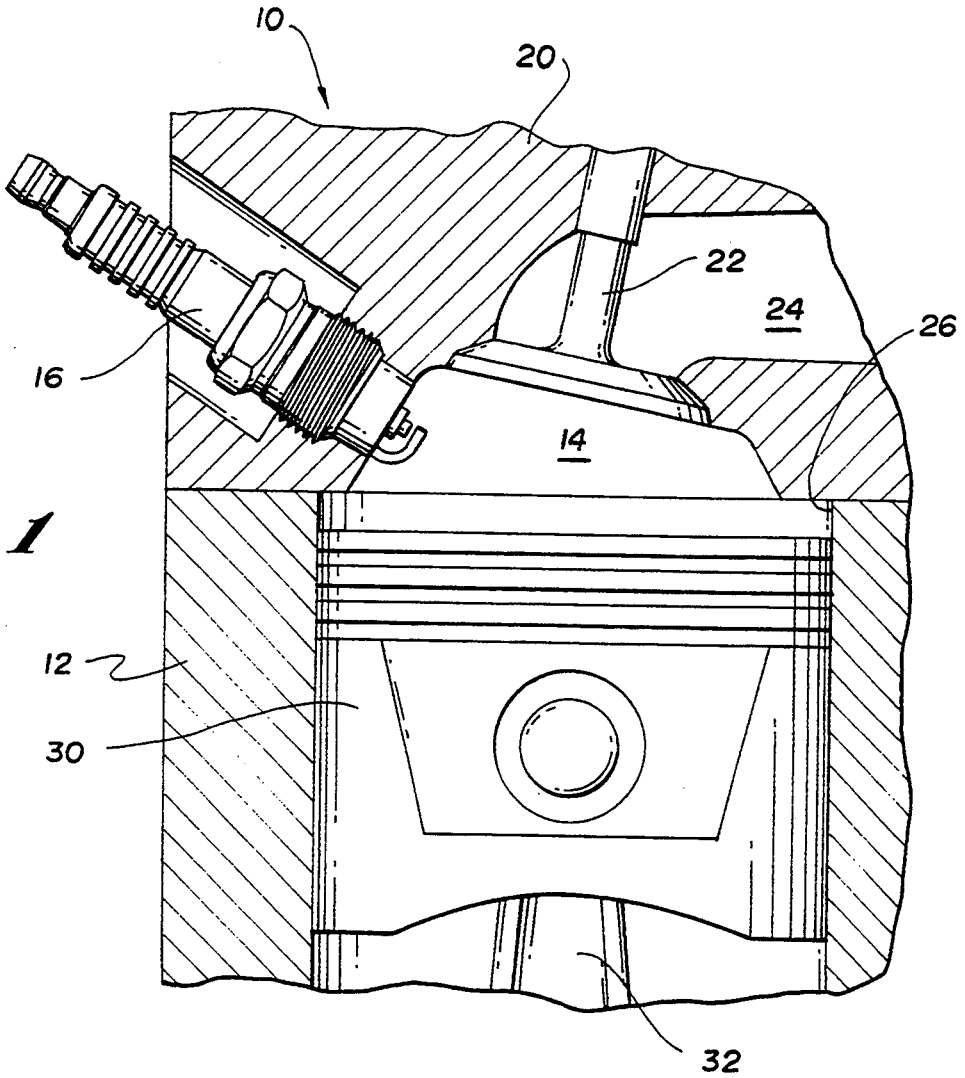
FIG. 1 is a fragmentary side view, partially in section, of a cylinder head and spark plug assembly, made in accordance with the present invention, mounting atop an engine block.
Figure 2:
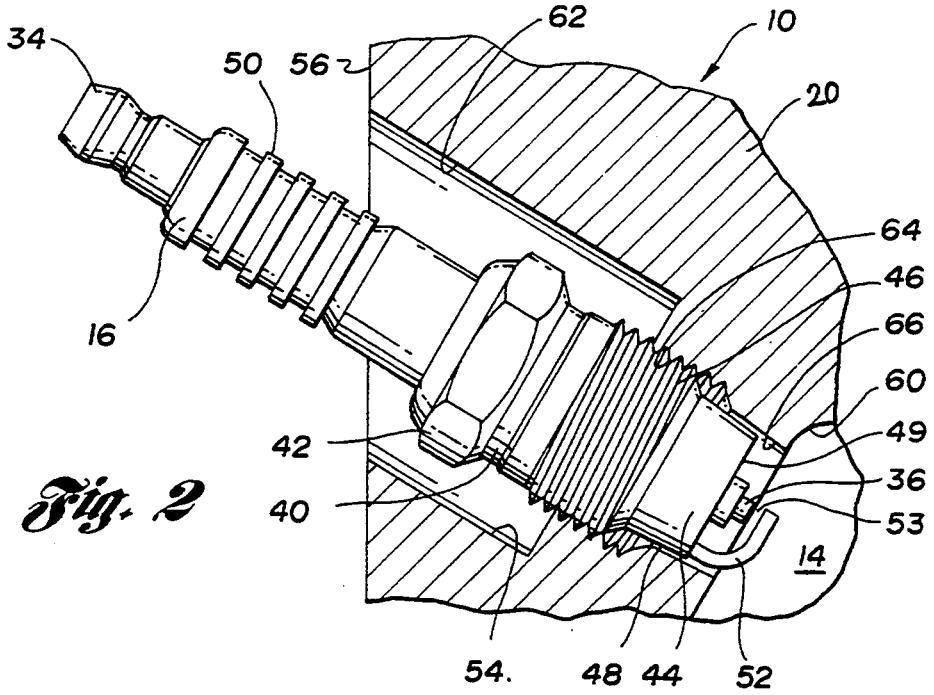
FIG. 2 is an enlarged view of a spark plug partially threaded into a spark plug bore of a cylinder head.
Figure 3:
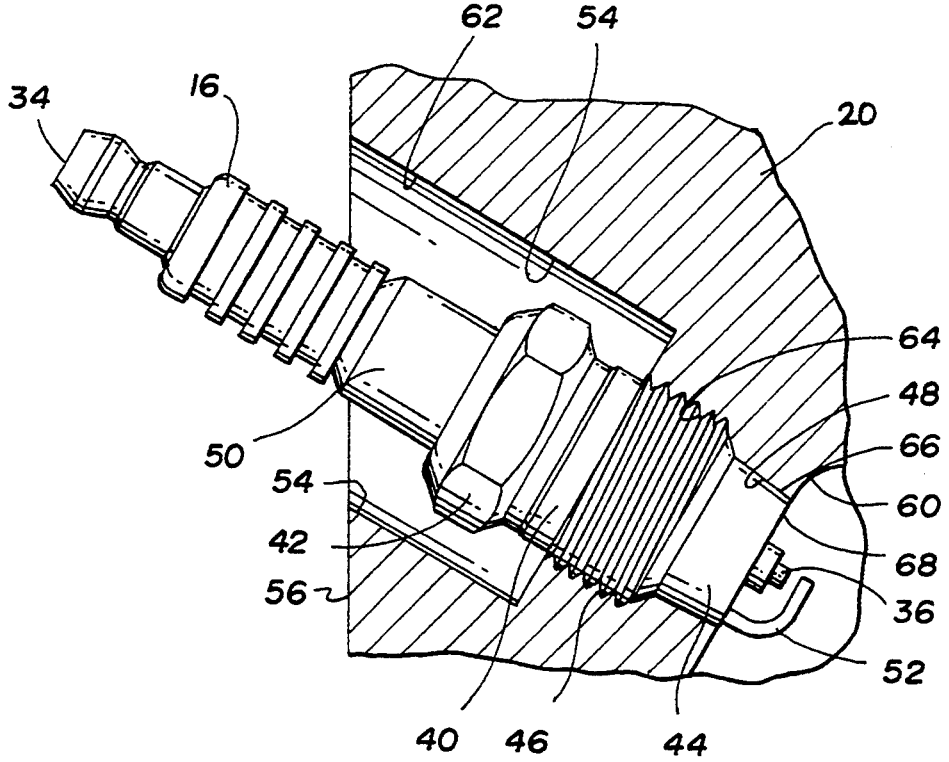
FIG. 3 is a view similar to FIG. 2 with the spark plug fully threaded into the spark plug bore with respective seal surfaces on the spark plug and cylinder head mating in an interference fit.

In FIGS. 1–3, a spark plug and cylinder head assembly 10, made in accordance with the present invention, is shown mating with an engine block 12 to define a combustion chamber 14. Cylinder head and spark plug assembly 10 includes a spark plug 16 mounted in a cylinder head 20. Also shown is an exhaust valve 22 located in an exhaust port 24. Exhaust valve 22 also partially defines the combustion chamber 14. A cylinder bore 26 in engine block 12 has a piston head 30 mounted therein and is attached to piston rod 32.

Referring specifically now to FIG. 2, spark plug 16 has a spark plug terminal 34 which is attached to a center electrode,36 which extends through the center and along the length of spark plug 16. A metallic spark plug body 40 includes a hex nut 42, a terminal end portion 44 and external threads 46 disposed between hex nut 42 and terminal end portion 44. Terminal end portion 44 includes a tapered circumferentially extending seal surface 48 and a radially extending end surface 49. Seal surface 48 tapers radially inwardly from external threads 46 to end surface 49. The taper angle is preferably between 0° and 10° and most preferably at 6°.

An insulator 50 is located between spark plug body 40 and central electrode 36. A ground electrode 52 extends from the terminal end portion 44. A spark gap 53 is created between the end of central electrode 36 and ground electrode 52.

Cylinder head 12 has a stepped spark plug bore 54 which extends downstream from an exterior surface 56 to an interior surface 60. Spark plug bore 54 includes an enlarged portion 62, a portion having internal threads 64 and a circumferentially extending seal surface 66. Tapered seal surface 66 tapers inwardly from internal threads 64 to interior surface 60. The taper is preferably between 2° and 12° and most ideally at 8°. The minor diameter of tapered seal surface 66 (i.e., the bore diameter at interior surface 60) is preferably equal to or just slightly greater than the minor diameter of plug seal surface 48 to thereby assure an interference fit at the interior surface 60 and thereby eliminate any possibility of a crevice between the plug and the cylinder head which is exposed to combustion fuel.

FIG. 2 shows that the external threads 46 are received within internal thread 64 prior to seal surface 48 of spark plug 16 engaging seal surface 66 of engine block 12. As spark plug 16 is further threaded into spark bore 54, tapered seal surfaces 48 and 66 will be drawn into a circumferentially extending interference fit.

Referring now to FIG. 3, spark plug 16 is shown fully installed within spark plug bore 54 of cylinder head 20. In this position, seal surface 48 mates with seal surface 66 in the interference fit. Therefore, no combustible gases can pass upstream beyond the interference fit. Further, no circumferentially extending crevice is formed between terminal end portion 44 of spark plug 16 and spark plug bore 54 on the combustion chamber side (i.e., downstream) of the interference fit.

Ideally, end surface 49 on terminal end portion 44 will form a flush surface with interior surface 60 of cylinder head 12 as shown in FIG. 3. However, due to the angular and diametrical manufacturing tolerances of seal surfaces 48 and 60, this flush condition may be difficult to exactly hold. Accordingly, the tapers on seal surfaces 48 and 66 are preferably designed such that the nearly flush condition will occur, or else, end surface 49 will extend slightly into combustion chamber 14 past interior surface 60. Although not preferred, it is also possible that end surface 49 could end up slightly within bore 54 (i.e., upstream) from interior surface 60.

In any of these conditions, all circumferentially extending crevices between terminal end portion 44 and spark plug bore 54 downstream of the interference fit will be eliminated. When the interference fit is flush or slightly upstream of interior surface 60, the interference fit will occur at the intersection or corner of seal surface 48 and end surface 49. If the end surface 49 is located downstream of interior surface 60, the interference fit will occur along the length of seal surface 66 upstream of end surface 49.

Figure 4:
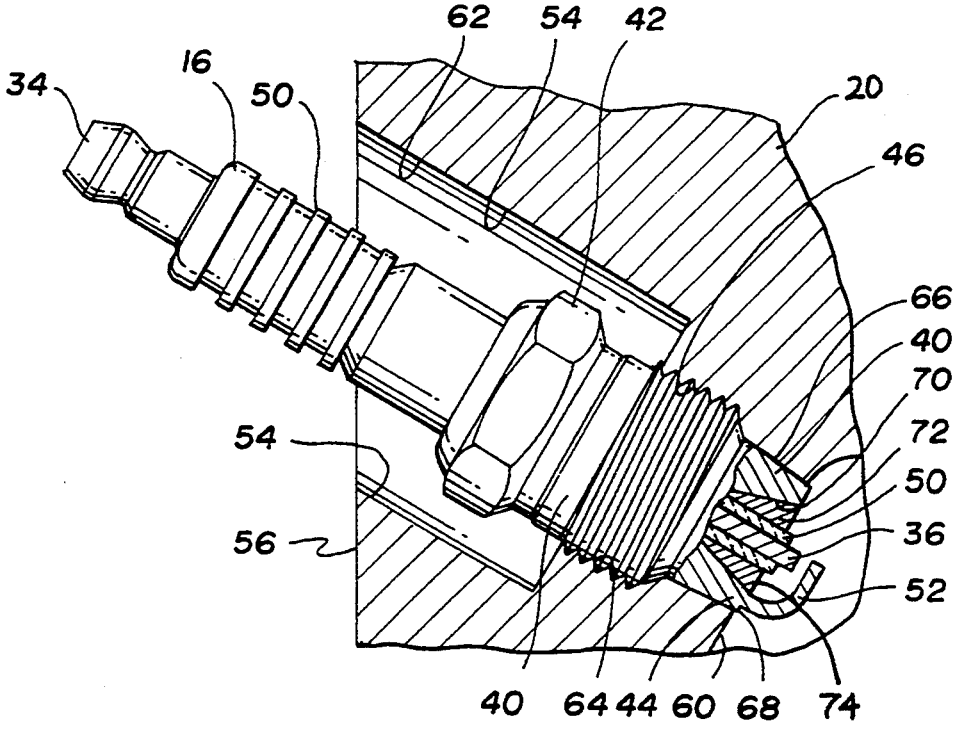
FIG. 4 is another embodiment, also made in accordance with this invention, wherein an filler element flushly fills a region between an insulator and a body of the spark plug adjacent a spark gap to eliminate any crevices therebetween.

FIG. 4 shows an alternative embodiment of the present invention. Similar reference numerals will be used for like components utilized in FIGS. 1–3. In the embodiment of FIG. 4, spark plug 16 includes an annular chamber 70 formed between an inner cylindrical surface of end portion 44 of body 40 and insulator 50 surrounding central electrode 36. Conventionally, this chamber or region is open forming an air gap between body 40 and insulator 50. However, in this second embodiment, annular chamber 70 is filled with a filler element 72 which forms a flush end surface 74. Accordingly, any crevices normally formed between spark plug body 40 and insulator 50 near the spark gap will be eliminated. Ideally, filler element 72 is made of a ceramic or composite material, and most preferably from thermally sprayed zirconia, which is a good insulator and can be applied with current technology.

While the foregoing specification of this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. A cylinder head and spark plug assembly for mating with an engine block having a cylinder therein to create a combustion chamber for burning combustible gases, the assembly comprising:

an integral cylinder head having an end wall with an exterior surface and an interior surface and a spark plug bore extending downstream from the exterior surface to the interior surface, the interior surface cooperable with a cylinder bore of an engine block to create a combustion chamber for burning combustible gases, the spark plug bore having a metallic seal surface adjacent the interior surface and internal threads disposed upstream from the seal surface; and a spark plug including a body terminating in an end portion having a seal surface thereon, a nut and external threads disposed between the nut and the seal surface, the external threads of the spark plug threadedly retained within the internal threads of the spark plug bore;

the spark plug seal surface cooperating with the cylinder head seal surface in an interference fit substantially eliminating any crevice between the end portion of the body and the spark plug bore downstream of the interference fit.

2. The assembly of claim 1 wherein:

at least one of the seal surfaces is tapered.

3. The assembly of claim 2 wherein: both seal surfaces are tapered, the seal surface on the bore tapering at a greater angle than the seal surface on the spark plug.

4. The assembly of claim 1 wherein:

the end portion of the spark plug has a radially extending end surface which is flush with the interior surface of the cylinder head.

5. The cylinder block of claim 1 wherein:

the end portion of the spark plug has a radially extending end surface which extends through the spark plug bore and downstream past the interior surface of the cylinder head.

6. A cylinder head and spark plug assembly for mating with an engine block having a cylinder bore therein to create a combustion chamber for burning combustible gases, the assembly comprising:

a cylinder head having an end wall with an exterior surface and an interior surface and a spark plug bore extending downstream from the exterior surface to the interior surface, the interior surface cooperable with a cylinder bore of an engine block to create a combustion chamber for burning combustible gases, the spark plug bore having a seal surface adjacent the interior surface and internal threads disposed upstream from the seal surface; and a spark plug including a body terminating in an end portion having a seal surface thereon, a nut and external threads disposed between the nut and the seal surface, the external threads of the spark plug threadedly retained within the internal threads of the spark plug bore;

the spark plug further having a central insulator disposed within the body with a central electrode extending through the insulator, and a ground electrode extending from the end portion forming a spark gap between the electrodes, an annular chamber being formed between the end portion and the insulator; and a filler element disposed in the annular chamber providing a radially extending flush surface between the terminal end portion and the insulator.

7. A method for mounting a spark plug in a cylinder head comprising:

placing a spark plug having a body with external threads and an end portion terminating in a circumferentially extending seal surface into a spark plug bore extending downstream between external and internal surfaces on a cylinder head, the bore having internal threads and a metallic seal surface downstream therefrom;

threading the external threads of the spark plug into the internal threads of the bore with the seal surface on the end portion mating with the metallic seal surface on the bore in an interference fit to fluidly seal between the body and the bore substantially eliminating any crevice therebetween downstream of the interference fit.

8. The method of claim 7 wherein:

at least one of the seal surfaces is tapered.

9. The method of claim 8 wherein:

both seal surfaces are tapered.

10. The method of claim 9 wherein:

the seal surface on the bore tapers at a greater angle than the seal surface on the end portion of the body.

11. A method for mounting a spark plug in a cylinder head comprising:

placing a spark plug having a body with external threads and an end portion terminating in a circumferentially extending tapered seal surface into a spark plug bore extending downstream between external and internal surfaces on a cylinder head, the bore having internal threads and a tapered seal surface downstream therefrom, the seal surface on the bore tapering at a greater angle than the seal surface on the end portion of the body;

threading the external threads of the spark plug into the internal threads of the bore with the seal surface on the end portion mating with the seal surface on the bore in an interference fit to fluidly seal between the body and the bore substantially eliminating any crevice therebetween downstream of the interference fit.

* * * * *